US005106095A

United States Patent [19]

Pitkethly

[11] Patent Number: 5,106,095

[45] Date of Patent: Apr. 21, 1992

[54] GOLF SWING DIAGNOSTIC AND TRAINING APPARATUS

[76] Inventor: John K. Pitkethly, 190 Desoto Pwky, Satellite Beach, Fla. 32937

[21] Appl. No.: 699,696

[22] Filed: May 14, 1991

[51] Int. Cl.[5] ..... A63B 69/36

[52] U.S. Cl. ..... 273/186 A; 273/193 R; 273/77 R

[58] Field of Search ..... 273/186 R, 186 A, 186 D, 273/193 R, 193 A, 193 B, 194 R, 194 A, 194 B, 183 D, 183 DA, 77 R, 81 C; 434/252

[56] References Cited

U.S. PATENT DOCUMENTS 2,005,915 6/1935 Grelle ..... 273/186 A
4,819,944 4/1989 Doane ..... 273/194 R
4,878,673 11/1989 Pollard ..... 273/186

*Primary Examiner*—George J. Marlo
*Attorney, Agent, or Firm*—Evenson, Wands, Edwards, Lenahan & McKeown

[57] ABSTRACT

An apparatus for teaching and diagnosing a golf swing includes first and second hand grips and a coupling device which holds the hand grips parallel to each other while allowing them a single degree of movement, toward or away from each other between innermost and outermost positions. The coupling device may be a pair of pistons having piston shafts coupled to the first hand grip and piston cylinders coupled to the second hand grip. Alternatively, the coupling device may be a pair of shafts having first ends fixedly coupled to the first hand grip and being slidably coupled to the second hand grip. When the hand grips move into the innermost and outermost positions, audible sounds are produced. The hand grips may include grip shafts coupled to the coupling device and handles either fixedly or rotatably disposed about the grip shafts. In a method for diagnosing a golf swing using the apparatus, a golfer grasps the hand grips and moves from the "addressing the ball" position through the backswing andd contact to the follow-through. At certain specific points in a correct swing, the hand grips make predictable movements and the apparatus produces audible sounds. Faults in the swing may be diagnosed by noting deviations between what the apparatus does and what it should do. The golfer may use the apparatus in a teaching method by repeating the proper swing in a training session to build up muscle memory of the proper swing.

23 Claims, 3 Drawing Sheets

GOLF SWING DIAGNOSTIC AND TRAINING APPARATUS

FIELD OF THE INVENTION

The invention generally relates to the field of golf accessories. More specifically, the invention relates to golf swing analysis, diagnostic, and training devices.

BACKGROUND OF THE INVENTION

One of the most fascinating and frustrating aspects of the game of golf is the eternal quest for the perfect golf swing. It is recognized that a technically correct swing brings about impressive and satisfying distance and accuracy, but that even minor deviations from the correct swing in any of a large number of areas drastically reduce the distance and accuracy of the stroke. A golf swing is an intricate combination of carefully synchronized muscle movements. Among the many important aspects of a correct swing are balance, timing, and synchronization of movements between the left and right halves of the body.

Mastering the correct golf swing requires diligent practice under careful guidance. After the correct swing has been mastered, from time to time a golfer experiences periods in which "his game is off" due to subtle deviations from the correct swing technique. Understanding a correct golf swing is perhaps even harder than mastering it. Bad habits unwittingly picked up are difficult to recognize and break. Most golfers have difficulty diagnosing these subtle technical problems in themselves. A golfer may endure frustrating performance or even develop bad habits before he, or an experienced golf instructor, realizes what the problem is.

In order for a golfer to maintain a technically correct swing, he thus needs prompt feedback to correct problems before they become ingrained bad habits. It is not always practicable for a golfer to consult an instructor in a timely fashion. Thus there is a need for an apparatus which a golfer may use to diagnose problems in his swing and from which a golfer may receive positive feedback for correct technique.

SUMMARY OF THE INVENTION

It is an object of the invention to provide an apparatus which a golfer may use to check and verify correct hand action during the course of a golf swing.

It is a further object of the invention to provide an apparatus which a golfer may use to check and verify correct motion of the left and right sides of the body during the course of a golf swing.

It is a further object of the invention to provide an apparatus which a golfer may use to check and verify correct timing during the course of a golf swing.

It is a further object of the invention to provide an apparatus which a golfer receives audible feedback while checking and verifying timing during the course of a golf swing To achieve these and other objects, there is provided in accordance with the invention a golf swing diagnostic and training apparatus comprising first and second hand grips, each hand grip having an axis, and a coupling device mechanically coupled to the first and second hand grips to hold the axes of the hand grips parallel to each other, the coupling device providing a single linear degree of freedom which allows the hand grips to move toward and away from each other between innermost and outermost positions while remaining parallel to each other.

Further in accordance with the invention, there is provided a golf swing diagnostic and training apparatus comprising first and second parallel shafts, a fixed hand grip rigidly coupled between first ends of the first and second shafts to be perpendicular to the first and second shafts, a movable hand grip slidably coupled to the first and second shafts for moving along the first and second shafts between an innermost position close to the fixed hand grip and an outermost position close to second grip, a first stop on at least one of the first and second shafts adjacent to the second end for stopping outward motion of the movable hand grip and making a first audible sound, and a second stop on at least one of the first and second shafts adjacent to the fixed hand grip for stopping inward motion of the movable hand grip and making a second audible sound.

Further in accordance with the invention there is provided a method for teaching and diagnosing a golf swing comprising the steps of:

holding a golf swing diagnostic and training apparatus having first and second hand grips, each hand grip having an axis, and a coupling device mechanically coupled to the first and second hand grips to hold the axes of the hand grips parallel to each other, the coupling device providing a single linear degree of freedom which allows the hand grips to move toward and away from each other between innermost and outermost positions while remaining parallel to each other;

moving through a backswing portion of the golf swing. wherein the hand grips should move to the outermost position at a first predetermined point in the backswing portion;

swinging forward from the backswing portion through a ball contact portion of the swing to a follow-through portion of the swing, wherein at a second predetermined point in the ball contact portion of the swing, the hand grips should move to the innermost position and remain in the innermost position throughout the follow-through portion of the swing;

noting deviations in the movements of the hand grips from the movements recited above, the deviations indicating problems in the golf swing.

An apparatus and method in accordance with the invention may be used by a golfer to diagnose golf swing problems when an instructor is not conveniently available A golfer having a fundamental knowledge of the correct golf swing may use the apparatus to verify that certain body motions in the swing are timed correctly. The golfer may do this by noting the movement of the grips of the apparatus at various points in the swing The golfer may recognize movements of the grips which deviate from the movements which should accompany a correct swing, and diagnose specific problems in the swing accordingly.

The apparatus and method may also be used for teaching a correct golf swing. By using the apparatus and the method, a student golfer receives feedback from the apparatus which makes it easy to tell that a golf swing is correct. The golfer may then repeat the correct swing in a training session to build up muscle memory of the proper swing.

BRIEF DESCRIPTION OF THE DRAWINGS

The invention as described in the following detailed description and recited in the appended claims will be better understood with reference to the appended drawings, in which:

DETAILED DESCRIPTION OF THE PREFERRED EMBODIMENTS

An apparatus according to the invention may broadly be described as including first and second hand grips, each hand grip having an axis, and a coupling device mechanically coupled to the first and second hand grips to hold the axes of the hand grips parallel to each other, the coupling device providing a single linear degree of freedom which allows the hand grips to move toward and away from each other between innermost and outermost positions while remaining parallel to each other. In a preferred embodiment, the coupling device holds the hand grips in face-to-face alignment with each other.

Figure 1:
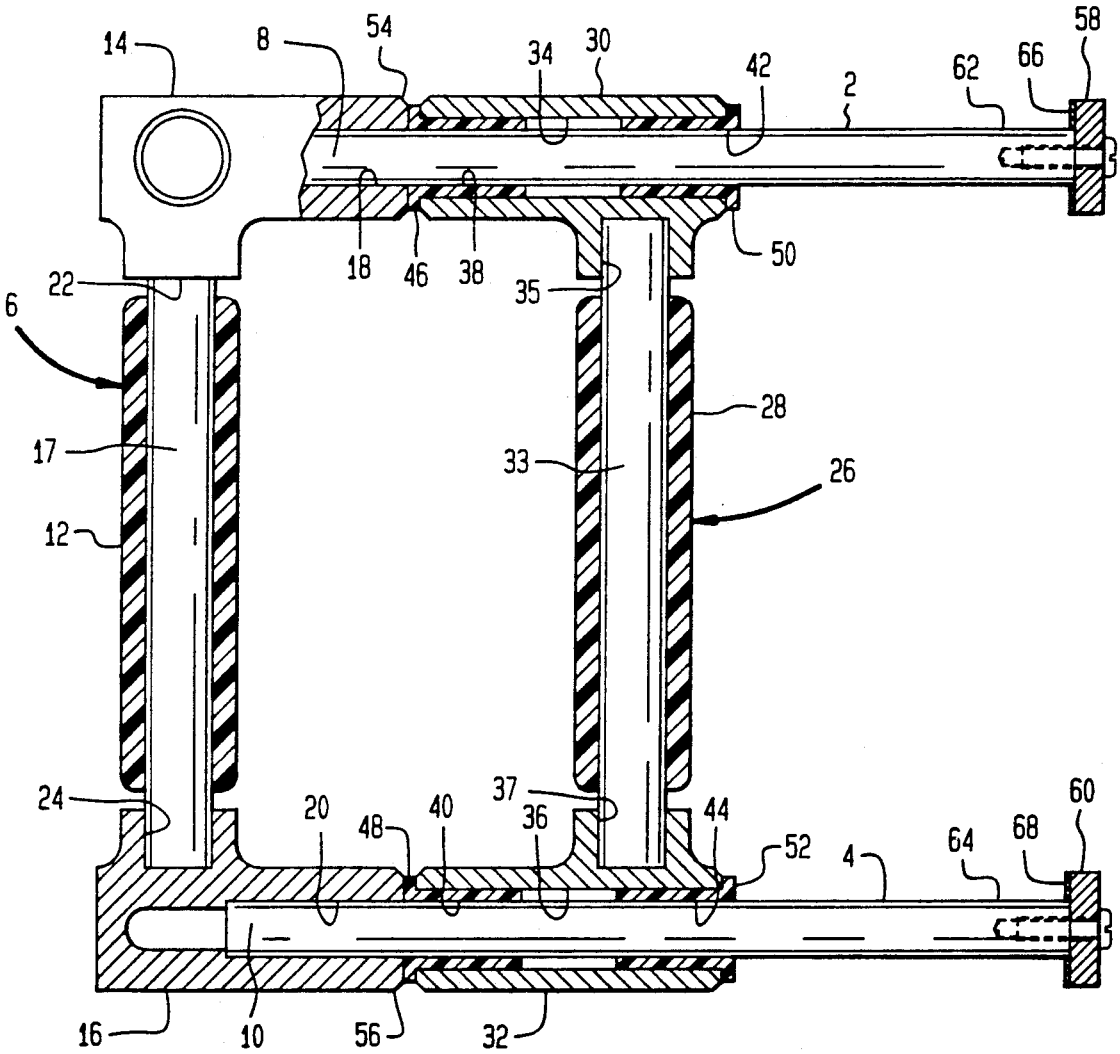
FIG. 1 is partial cutaway plan view of an apparatus according to a first embodiment of the invention.

FIG. 1 shows a plan view of a first preferred embodiment of the invention. Portions of the apparatus are cut away to provide views of components which would otherwise be concealed.

First and second shafts 2 and 4 are disposed parallel to each other. The shafts 2 and 4 may preferably be suitably sized segments of metallic tubing. A fixed hand grip 6 is coupled to first ends 8 and 10 of the shafts 2, 4, respectively. The fixed hand grip 6 includes a handle 12, a first shaft housing 14 (partially cut away), and a second shaft housing 16 (cut away). The fixed hand grip 6 may also include a grip shaft 17 running through the handle 12 between the shaft housings 14, 16. The handle 12 may be fixed to the grip shaft 17, or rotatable about the grip shaft 17. The shaft housings 14, 16 respectively have first apertures 18, 20 for receiving the first ends 8, 10. The first apertures 18, 20 have interior dimensions approximately identical to exterior dimensions of the shafts 2, 4 such that the shafts 2, 4 snugly fit inside the first apertures 18, 20.

The shaft housings 14, 16 also have second apertures 22, 24 for receiving ends of the fixed grip 6 The shaft housings 14, 16 thus hold the shafts 2, 4 rigidly parallel to each other and perpendicular to the fixed grip 6 The handle 12 is preferably made of a firm, resilient material such as plastic, and may have a textured or resilient surface suitable for being gripped by a person using the apparatus. Also, the outer surface of the handle 12 may be contoured with finger grips, etc., to conform the hand of the person using the apparatus.

A movable grip 26 is coupled to the shafts 2, 4 as well. The movable grip 26 includes a handle 28 essentially similar to the handle 12, a first slide housing 30 slidably coupled to the first shaft 2, and a second slide housing 32 slidably coupled to the second shaft 4. There may also be a grip shaft 33 running through the handle 28. The handle 28 may either be fixed to the grip shaft 33 or freely rotatable around the grip shaft 33. Both of the slide housings 30, 32 are shown in cutaway view The slide housings 30, 32 have first apertures 34, 36, respectively, for accommodating the shafts 2, 4. The first apertures 34, 36 have larger interior dimensions than the exterior dimensions of the shafts 2, 4. Bushings 38, 40, 42, 44 are disposed inside the apertures 34, 36 for taking up the space between the exterior of the shafts 2, 4 and the apertures 34, 36. The slide housings 30, also have second apertures 35, 37, respectively, into which ends of the movable hand grip 26 are inserted.

In the embodiment shown, grip shafts of the grips 6, 26 are fixedly inserted into the second apertures 22, 24 and 35, 37 of the shaft and slide housings In an alternative embodiment, the hand grips 6 and 26 may be rotatably inserted into the second apertures 22, 24 and 35, 37. In this latter case, the hand grips 6, 26 might each be a unitary construction, or might, again, include a handle fixed to a grip shaft. Thus, various embodiments of the invention may provide a handle or grip which is rotatable about an axis running through the handle or grip. In these alternative embodiments, however, the handles or grips maintain only one linear degree of freedom of motion with respect to each other. That is, the handles or grips move linearly toward or away from each other while remaining parallel to each other.

From FIG. 1, it will be seen that the fixed grip 6 and the movable grip 26 have ends which are mechanically coupled to the shafts 2, 4. Thus in this embodiment, the hand grips 6, 26 are in face-to-face alignment with each other.

The bushings 38 through 44 each have a portion which fits between the respective aperture and shaft, and a flange which rests against an end of the respective slide housing at the mouth of the aperture. The flanges are shown as 46, 48, 50, and 52. The flanges act as bumpers to prevent damage or wear as the movable grip 26 moves and strikes the shaft housings 14, 16, while providing an audible sound when they strike, to let the user of the apparatus know that his or her hands have come together. As will be explained below, the hands should come together at a predetermined point in the swing. The sound lets the user know that this is happening at the right point in the swing.

The first and second shaft housings 14 and 16 have ends 54 and 56, respectively. The ends 54 and 56 surround the shafts 2 and 4, respectively. The ends 54 and 56 serve as stops for the movable grip 26. When the movable grip 26 moves to the innermost position, the flanges 46 and 48 strike the ends 54 and 56, respectively. A first audible sound results.

The apparatus also includes end stops 58 and 60. The end stops 58 and 60 ar: mounted at second ends 62 and 64 of the shafts 2 and 4. The end stops 58 and 60 also serve as stops for the movable, grip 26. The end stops have bumpers 66, 68 which face the movable grip 26 and come into contact with the flanges 50 and 52 when the movable grip 26 moves to its outermost position. When the movable grip 26 moves to the outermost position, the flanges 50 and 52 strike the bumpers 66 and 68, producing a second audible sound. The person using the apparatus may listen for the first and second sounds and determine whether the sounds occur at the points in the golf swing that they should. The end stops 58, 60 are secured to the second ends 62, 64 by bolts 70 and 72.

While the audible sounds in the preferred embodiment are produced by striking the flanges of the movable grip 26 against the ends 54, 56 or the bumpers 66, 68, in alternative embodiments the sounds could be produced electronically. For instance, the shaft housings 14, 16 or the slide housings 30, 32 may include circuitry having a power source such as a small battery, a sound generator such as a beeper or oscillator, and a pair of contacts. When the movable grip strikes the ends or bumpers, an electrically conductive strip thereon may short the contacts and complete a circuit, thereby causing current to flow through the beeper.

Golfers who use the apparatus will, of course, vary in height, arm length, and other morphological features. The play of the movable grip 26, i.e., the total distance between the innermost and outermost positions over which the movable grip 26 moves, may have an optimal value for a given person using the apparatus. The proper distance for the given user of the apparatus may be based on "feel", i.e., a distance which the user finds comfortable and which most closely simulates the sensation of an actual golf swing with a golf club. Accordingly, The apparatus may be provided in a variety of sizes, such as Small, Medium, Large, and Extra Large, each successively larger size having a slightly longer play. Other dimensions, such as the width of the hand grips, may vary as well. In addition, men's and women's sizes may each be provided. As an alternative, the apparatus may be provided in a "one size fits all" configuration, in which the apparatus may have a suitable mechanism for adjusting the play. A user of such an alternative apparatus might preferably set the play for his particular size and comfort when first acquiring the apparatus, and not change the play thereafter.

Figure 2:
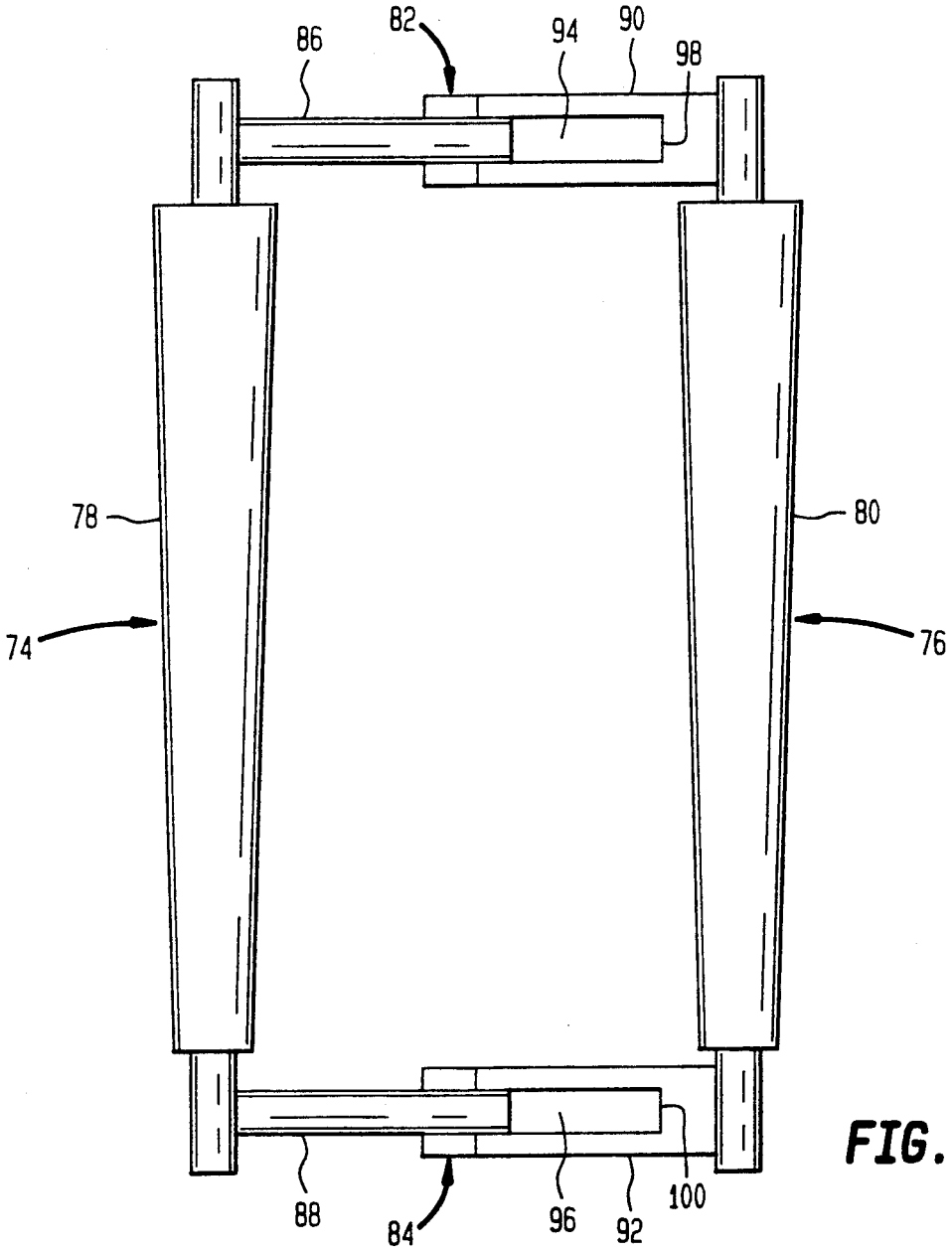
FIG. 2 is a schematic diagram of an apparatus according to a second embodiment of the invention.

FIG. 2 shows an alternative embodiment of the apparatus. First and second grips 74 and 76 include handles 78 and 80 which may be substantially similar to the handles 12 and 28 of the FIG. 1 apparatus. Alternatively, the handles 78, 80 may be slightly conical as shown in FIG. 2. As an alternative to the first and second shafts 2, 4 of the embodiment of FIG. 1, the embodiment of FIG. 2 includes first and second pistons 82 and 84. The pistons respectively include piston shafts 86 and 88 which are fixedly coupled to the first grip 74 parallel to each other and at right angles to the first grip 74. The pistons also include piston cylinders 90 and 92 which are fixedly coupled to the second grip 76 parallel to each other and at right angles to the second grip 76. The piston cylinders 90, 92 have openings 94, 96 for receiving the piston shafts 86, 88. The piston shafts 86, 88 and the piston cylinders engage each other and move coaxially as the grips 74, 76 move toward or away from each other. The openings 94, 96 have ends 98, 100 which serve as stops for the piston shafts 86, 88. The piston shafts 86, 88 may move into the openings 94, 96 until the piston shafts 86, 88 strike the ends 98, 100. This position corresponds to an innermost position of the hand grips 74, 76. Also, when the shafts 86, 88 strike the ends 98, 100, an audible sound is produced The golfer using the apparatus may listen for the sound when going through a swing.

Figure 3:
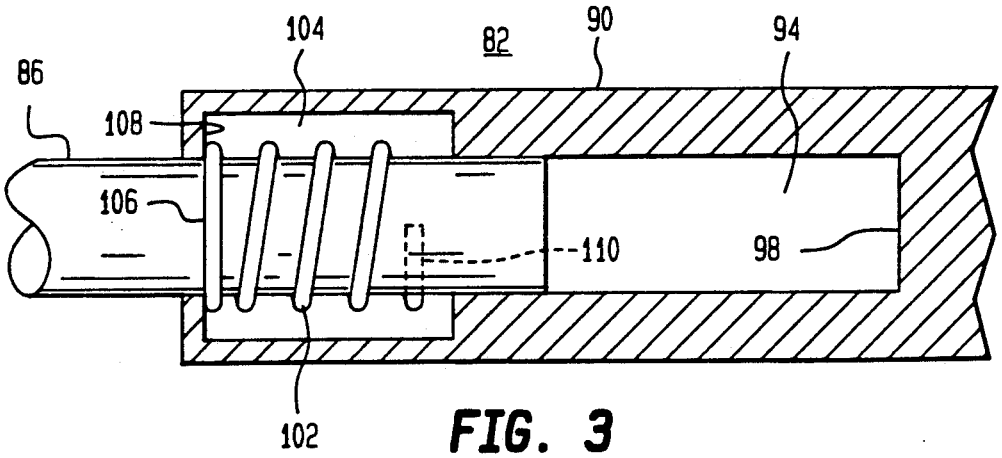
FIG. 3 is a detailed portion of the embodiment of FIG. 2.

FIG. 3 is a magnified view of a portion of the piston 82 of FIG. 2. The structure shown and described below is substantially identical to the structure of the piston 84.

The piston shaft 86, the piston cylinder 90, and the opening 94 are visible. There is additionally shown a spring 102 which surrounds and is aligned coaxially with the piston shaft 86. The spring 102 in enclosed inside a chamber 104 within the piston cylinder 90. A first end 106 of the spring 102 abuts a wall 108 of the chamber 104. A second end 110 of the spring 102 is mechanically coupled to the piston shaft 86. As the hand grips 74, 76 move apart, the spring 102 is compressed At an outermost position of the hand grips 74, 76, the spring 102 is fully compressed, and the piston shaft 86 is prevented from moving any farther out of the opening 94. Also, an audible sound is produced as the spring 102 is compressed between the wall 108 and the point on the shaft 86 at which the second end 110 is coupled.

In addition to restraining the piston shaft from moving completely out of the piston cylinder, the spring 102 serves as a compression spring for biasing the piston shaft and cylinder into a predetermined state, i.e., biasing the hand grips a predetermined distance apart. The spring 102 may be used this way to provide a "feel" for the device which may more closely simulate the feel of an actual golf club, or which, during a practice swing, may more closely simulate the feel of an actual swing. Springs may be used similarly with the embodiment of FIG. 1. For instance, springs could be disposed between the first shaft housing 14 and the first slide housing, between the first slide housing 30 and the end stop 58, etc. In such cases, the springs would have relative tensions, etc., which would provide the desired feel. Other suitable means for urging the hand grips to a predetermined position, such as an arrangement of magnets, mechanical dampers, etc., may be used in place of or in addition to springs.

Figure 4:
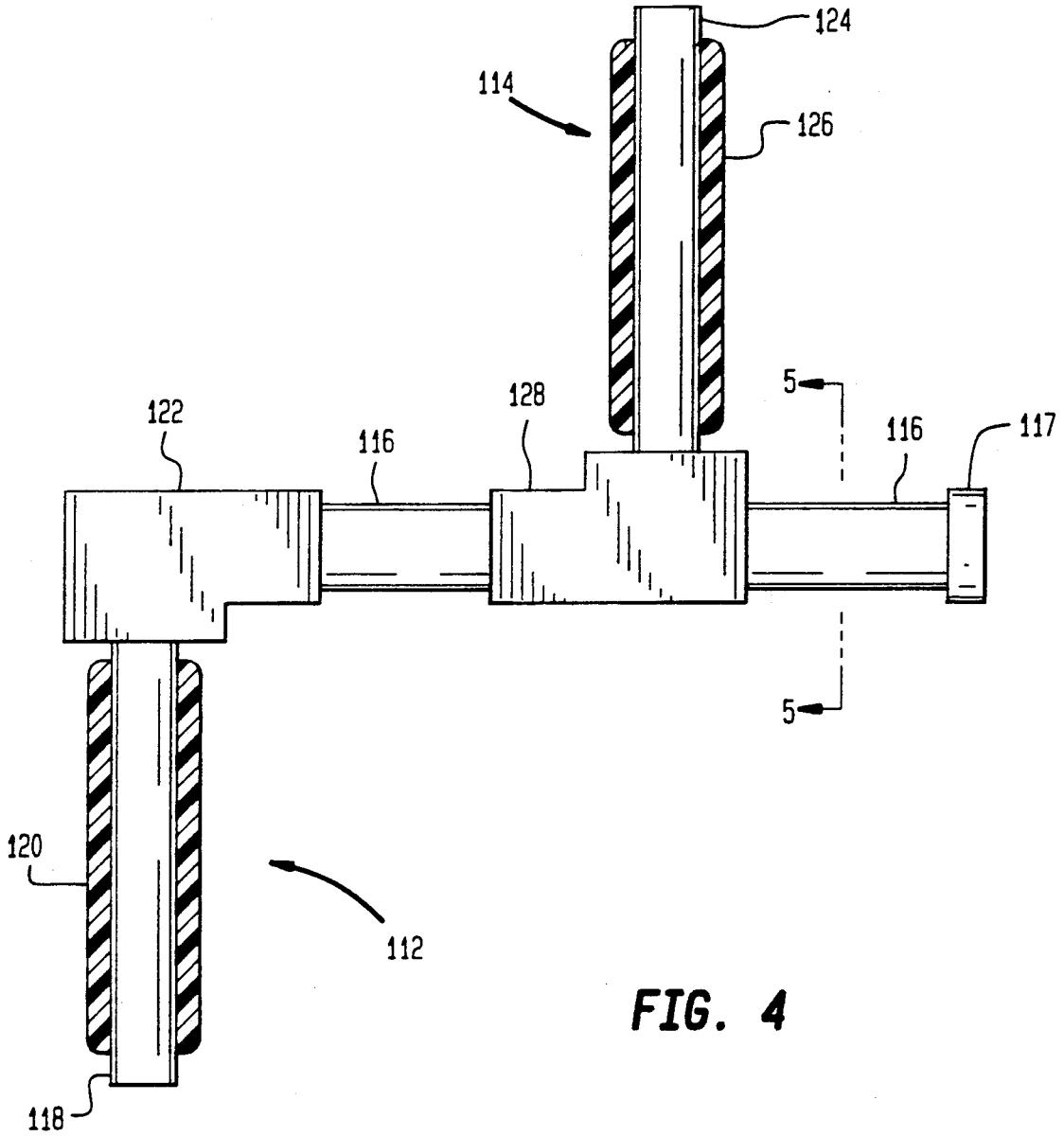
FIG. 4 is a schematic view of an apparatus according to a third embodiment of the invention.

In the embodiments shown, the hand grips are in face-to-face alignment with each other. However, in accordance with the invention this need not be the case. In a correct grip on a golf club, the golfer's hands are in end-to-end alignment. An apparatus according to the invention could also have hand grips in end-to-end alignment with each other more closely to simulate a grip on a golf club. For instance, FIG. 4 shows a schematic view of an apparatus including first and second hand grips 112 and 114, and a coupling device shown as a single shaft 116 having an end stop 117.

Figure 5:
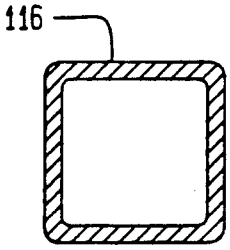
FIGS. 5, 6, and 7 are cross-sectional views of three embodiments of the apparatus of FIG. 4, taken along the line V—V.

The hand grip 112 may preferably be a fixed grip including a grip shaft 118, a handle 120, and a shaft housing 122. The hand grip 114 is a movable grip, and includes a grip shaft 124, a handle 126, and a slide housing 128. For the most part, the components shown resemble the comparable components of the embodiment of FIG. 1. However, the hand grips 112, 114 are not coupled to other components at both ends. Thus, in addition to the linear degree of freedom of motion, away from and toward each other, the hand grips could additionally be able to rotate about the shaft 116 if the shaft 116 has a circular cross-section. It is deemed preferable not to allow this additional rotational degree of freedom of movement, but rather to restrict the hand grips to the single linear degree of freedom. This may be accomplished by using a shaft 116 which has a non-circular cross section. Preferably, a shaft having a square cross section is used (see FIG. 5). Square tube material which may be cut to size to serve as such a shaft is readily available. This type of shaft may thus be employed without unduly increasing the cost of the apparatus.

Figure 6:
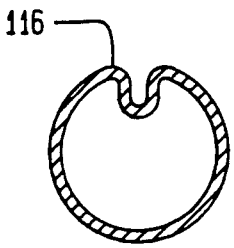
Figure 7:
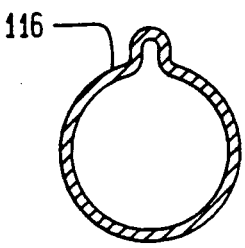

Alternatively, the shaft 116 may be substantially circular in cross-section, but having a slot running along its length (see FIG. 6). A portion of the hand grip 114 may have a tongue which is disposed inside the slot, so that the hand grip 114 slides along the shaft 116 but does not rotate about the shaft 116. Accordingly, the hand grips 112 and 114 remain parallel with each other. The tongue may preferably be on the slide housing 128, but could be at a suitable position facing the shaft 116 for other suitable configurations of the hand grip 114. Also, in other embodiments of the apparatus in accordance with the invention, both the hand grips 112 and 114 could be slidable along the shaft 116. In such other embodiments, each of the hand grips could have a tongue inserted in the same slot, or there could be two different slots. Also, the shaft 116 could be configured to have a ridge running along its length (see FIG. 7), and the slide housing 128 could have a notch for accommodating the ridge.

Any of the embodiments of the apparatus described above or other embodiments within the spirit and scope of the invention may be used in a method for teaching and diagnosing a golf swing in accordance with &he invention. The method is practiced while holding the apparatus. The golfer grasps the apparatus by the two grips (6 and 26, or 74 and 76). While grasping the apparatus, the golfer may move his or her hands toward or away from each other between the innermost and outermost positions, but is restrained from making other hand movements if an apparatus in which the handles are fixed to the grip shafts is used. If an apparatus in which the handles are freely rotatable axially about the grip shafts is used, then an additional degree of freedom of movement is provided In this latter case, as the apparatus moves into the backswing or follow-through portions of the swing, the handles rotate as the relative attitudes of the apparatus and the golfer's hands change. It has been found that an apparatus having rotatable handles is particularly well suited for a training method, in which the golfer repeats a correct swing to build up muscle memory. On the other hand, an apparatus having fixed handles has worked well in a diagnostic method for identifying problems in a golf swing.

While holding the apparatus, the golfer moves his or her hands and body through the sequence of movements making up the golf swing From the initial "addressing the ball" position facing forward and downward, the golfer moves to the side and upward into the backswing portion of the swing. As the golfer's hands move upward, they separate, pulling the grips of the apparatus away from each other toward the outermost position. At a predetermined point in the backswing, the golfer's hands should move apart. When the apparatus is used, the grips move to the outermost position, and the audible sound is produced. The golfer may check his or her timing, particularly synchronization of the motions of the left and right halves of the body, by listening for the sound at the predetermined point.

As the swing progresses, the golfer brings his or her hands back down to the point at which contact with the ball is made. At the point of contact, the hands come together, when the apparatus is used, the hand grips move to their innermost position, and another audible sound is produced. Again, the golfer may check his or her timing by noting whether the sound occurs before, at, or after the point of contact.

After the point of contact and during the follow-through portion of the swing, the golfer's hands move upward in the direction the ball was driven. If proper balance and left-right synchronization is maintained throughout the follow-through, the hands should remain together in the innermost position. Loss of proper balance, such as swaying, may cause the hands to separate. Thus, this problem in the swing may be diagnosed by noting that the hand grips either moved out of the innermost position and remained out, or moved out and back in, producing an extra sound.

The basic method for using the apparatus as described above may be applied to a training method, as well as a diagnostic method. As described above, various problems in a golf swing may be detected and diagnosed based on how the apparatus operates during the swing On the other hand, a golfer may use the apparatus in a training method in which the basic operation of the apparatus is repeated in order to build up a muscle memory of the correct swing. Since problems in the swing become readily apparent through use of the apparatus, practice with the apparatus will train the golfer in the correct swing, and not allow bad habits to develop.

In addition, an apparatus essentially similar to that here disclosed may be used in an essentially similar method for teaching and diagnosing physical movements associated with other sports, particularly swinging movements for other athletic implements. For instance, the swings of a tennis racquet, particularly a two-handed swing, or of a baseball bat, include a series of coordinated muscle movements from a backswing or cocked position, through a point of contact, to a follow-through. An apparatus and method, similar to that disclosed here but suitably adapted for the particular type of swing to be taught or diagnosed, may be used for balance, coordination of hand movements, etc.

The invention has been described in terms of preferred embodiments. However, it will be understood that the disclosed embodiments are exemplary, not limiting or exhaustive of the invention. All equivalent apparatus, methods, etc., which would be evident or obvious to a person of ordinary skill in the art based on the foregoing disclosure shall be deemed within the spirit and scope of the invention.

What is claimed is:

1. A golf swing diagnostic and training apparatus comprising:

first and second hand grips, each hand grip having an axis, and a coupling device mechanically coupled to the first and second hand grips to hold the axes of the hand grips parallel to each other, the coupling device providing a single linear degree of freedom of movement which allows the hand grips to move toward and away from each other between innermost and outermost positions while remaining parallel to each other.

2. A golf swing diagnostic and training apparatus as recited in claim 1 wherein each hand grip includes a handle and a grip shaft running through the handle.

3. A golf swing diagnostic and training apparatus as recited in claim 2 wherein, for each grip, the handle and the grip shaft are fixed to each other.

4. A golf swing diagnostic and training apparatus as recited in claim 2 wherein, for each grip, the handle is disposed about the grip shaft freely to rotate thereabout.

5. A golf swing diagnostic and training apparatus as recited in claim 1 wherein the coupling device includes first and second shafts which have first ends fixedly coupled to the first hand grip which is a fixed grip, the first and second shafts being slidably coupled to the second hand grip which is a movable grip.

6. A golf swing diagnostic and training apparatus as recited in claim 5 wherein the first and second shafts each have second ends, the apparatus further comprising:

a first stop on at least one of the first and second shafts adjacent to the second end for stopping outward motion of the movable grip and making a first audible sound; and a second stop on at least one of the first and second shafts adjacent to the first grip for stopping inward motion of the movable grip and making a second audible sound.

7. An apparatus as recited in claim 6 further comprising means for setting a position of the first stop for establishing a predetermined distance between the innermost and outermost positions of the movable grip.

8. An apparatus as recited in claim 5 wherein the movable grip includes first and second slide members disposed on the first and second shafts, respectively.

9. An apparatus as recited in claim 5 further comprising means for urging the movable grip to a predetermined position along the shafts.

10. An apparatus as recited in claim 9 wherein the means for urging include first and second compression springs disposed along the first and second shafts, respectively, and coupled between the fixed and movable grips.

11. A golf swing diagnostic and training apparatus as recited in claim 1 wherein the coupling device includes first and second pistons, each piston having a piston shaft coupled to the first hand grip, each piston having a piston cylinder coupled to the second hand grip.

12. A golf swing diagnostic and training apparatus as recited in claim 11 wherein each piston cylinder includes a chamber through which the piston shaft runs, each chamber having a wall, and the apparatus further comprises springs disposed inside the chambers, the springs having first ends which abut the walls of the chambers and second ends mechanically coupled to the piston shafts.

13. A golf swing diagnostic and training apparatus as recited in claim 1 wherein the coupling device includes a first shaft which has a first end fixedly coupled to the first hand grip which is a fixed grip, and which is slidably coupled with the second hand grip which is a movable grip.

14. A golf swing diagnostic and training apparatus as recited in claim 13 wherein the first shaft has a square cross section.

15. A golf swing diagnostic and training apparatus as recited in claim 13 wherein the first shaft has a groove running along its length.

16. A golf swing diagnostic and training apparatus as recited in claim 13 wherein the first shaft has a ridge running along its length.

17. A golf swing diagnostic and training apparatus comprising:

first and second parallel shafts, each shaft having a first and a second end;

a fixed grip rigidly coupled between the first ends of the first and second shafts to be perpendicular to the first and second shafts; and a movable grip slidably coupled to the first and second shafts for moving along the first and second shafts between an innermost position close to the fixed grip and an outermost position close to the second ends of the shafts while remaining parallel to the first grip.

18. A method for diagnosing a golf swing comprising the steps of:

holding a golf swing diagnostic and training apparatus having first and second hand grips, each hand grip having an axis, and a coupling device mechanically coupled to the first and second hand grips to hold the axes of the hand grips parallel to each other, the coupling device providing a single linear degree of freedom which allows the hand grips to move toward and away from each other between innermost and outermost positions while remaining parallel to each other;

moving through a backswing portion of the golf swing, wherein the hand grips should move to the outermost position at a first predetermined point in the backswing portion;

swinging forward from the backswing portion through a ball contact portion of the swing to a follow-through portion of the swing, wherein at a second predetermined point in the ball contact portion of the swing, the hand grips should move to the innermost position and remain in the innermost position throughout the follow-through portion of the swing; and noting deviations in the movement of the hand grips from the movements recited above which indicate problems in the golf swing.

19. A method for diagnosing a golf swing as recited in claim 18 wherein:

the coupling device includes first and second stops which limit movement of the hand grips to the outermost and innermost positions, respectively;

the apparatus makes first and second audible sounds, respectively, when the coupling device reaches the first and second stops; and the method further includes the steps of listening for the first sound at the first predetermined point and listening for the second sound at the second predetermined point.

20. A method for diagnosing a golf swing as recited in claim 18 further comprising the step of listening for an absence of the first and second sounds during the follow-through portion of the golf swing.

21. A method for diagnosing a golf swing as recited in claim 18 wherein:

the first stop is movable and may be fixedly secured at a desired location corresponding with a predetermined distance between the hand grips; and the method further comprises the step of fixedly securing the first stop at a location which provides a suitable feel for a user of the apparatus.

22. A method for teaching a golf swing comprising the steps of:

holding a golf swing diagnostic and training apparatus having first and second hand grips, each hand grip having an axis, and a coupling device mechanically coupled to the first and second hand grips to hold the axes of the hand grips parallel to each other, the coupling device providing a single linear degree of freedom which allows the hand grips to move toward and away from each other between innermost and outermost positions while remaining parallel to each other;

moving through a backswing portion of the golf swing, wherein the hand grips should move to the outermost position at a first predetermined point in the backswing portion;

swinging forward from the backswing portion through a ball contact portion of the swing to a follow-through portion of the swing, wherein at a second predetermined point in the ball contact portion of the swing, the hand grips should move to the innermost position and remain in the innermost position throughout the follow-through portion of the swing; and repeating the steps of holding, moving, and swinging, thereby developing muscle memory of the correct swing 23. A method for teaching and diagnosing a swing for an athletic implement comprising the steps of:

holding a diagnostic and training apparatus having first and second hand grips, each hand grip having an axis, and a coupling device mechanically coupled to the first and second hand grips to hold the axes of the hand grips parallel to each other, the coupling device providing a single linear degree of freedom which allows the hand grips to move toward and away from each other between innermost and outermost positions while remaining parallel to each other;

moving to a cocked position of the athletic implement, wherein the hand grips should move to the outermost position;

swinging forward from the cocked position through a point of contact portion of the swing to a follow-through portion of the swing, wherein at a predetermined point in the point of contact portion of the swing, the hand grips should move to the innermost position and remain in the innermost position throughout the follow-through portion of the swing;

repeating the steps of holding, moving, and swinging, thereby developing muscle memory of the correct swing; and noting deviations in the movement of the hand grips from the movements recited above which indicate problems in the swing.

* * * * *